US006929563B2

(12) United States Patent
Nishitani

(10) Patent No.: US 6,929,563 B2
(45) Date of Patent: Aug. 16, 2005

(54) IRON TYPE GOLF CLUB HEAD

(75) Inventor: Masafumi Nishitani, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/422,822

(22) Filed: Apr. 25, 2003

(65) Prior Publication Data

US 2003/0236134 A1 Dec. 25, 2003

(30) Foreign Application Priority Data

Jun. 20, 2002 (JP) ..... 2002-180277

(51) Int. Cl.[7] ..... A63B 53/04

(52) U.S. Cl. ..... 473/334; 473/335; 473/349; 473/350

(58) Field of Search ..... 473/345, 346, 473/349, 350, 330, 331, 332, 333, 334, 335, 336, 337, 338, 339

(56) References Cited

U.S. PATENT DOCUMENTS

| | | | | | |
|---|---|---|---|---|---|
| 2,846,228 | A | * | 8/1958 | Reach | 473/332 |
| 4,824,110 | A | * | 4/1989 | Kobayashi | 473/332 |
| 4,883,274 | A | * | 11/1989 | Hsien | 473/335 |
| 4,964,640 | A | * | 10/1990 | Nakanishi et al. | 473/335 |
| 5,421,577 | A | * | 6/1995 | Kobayashi | 473/335 |
| 5,439,223 | A | * | 8/1995 | Kobayashi | 473/334 |
| 5,584,770 | A | | 12/1996 | Jensen | |
| 5,749,794 | A | | 5/1998 | Kobayashi et al. | |
| 5,795,245 | A | | 8/1998 | Chang et al. | |
| 5,833,551 | A | | 11/1998 | Vincent et al. | |
| 6,030,293 | A | * | 2/2000 | Takeda | 473/334 |
| 6,743,112 | B2 | * | 6/2004 | Nelson | 473/251 |

FOREIGN PATENT DOCUMENTS

| | | | |
|---|---|---|---|
| JP | 6-343722 | A | 12/1994 |
| JP | 9-66125 | A | 3/1997 |
| JP | 9-66126 | A | 3/1997 |
| JP | 11-4922 | A | 1/1999 |
| JP | 2000-84126 | A | 3/2000 |

* cited by examiner

*Primary Examiner*—Sebastiano Passaniti
(74) *Attorney, Agent, or Firm*—Sughrue Mion, PLLC

(57) ABSTRACT

A golf club head has a head body, filler fixedly attached to the head body 1 by press fitting into a recess portion of the head body, and a back weight disposed on the rear surface side of the filler and fixedly attached to a sole portion of the head body. Titanium, titanium alloys, aluminum, aluminum alloys and magnesium alloys are preferable as the filler. The back weight may be made of the same material as the head body or may be made of metal higher in specific gravity than the head body.

13 Claims, 2 Drawing Sheets

IRON TYPE GOLF CLUB HEAD

The present disclosure relates to the subject matter contained in Japanese Patent Application No. 2002-180277 filed on Jun. 20, 2002, which is incorporated herein by reference in its entirety.

BACKGROUND OF THE INVENTION

1. Field of the Invention

The present invention relates to an iron type golf club head, and particularly relates to improvement of an iron type golf club head in which a recess portion is formed in the rear surface of a head body and filled with a metal having low specific gravity.

2. Description of the Related Art

As disclosed in JP-A-11-4922, some known iron type golf club heads belong to a cavity back type in which a recess portion provided in the back surface of a head body is left as a cavity, but some known iron type golf club heads belong to a type in which such a recess portion is filled with a metal having low specific gravity. The former cavity back type of iron type golf club heads has a large sweet spot. On the other hand, not only does the latter type of iron type golf club heads with a recess portion filled with a metal having low specific gravity have a large sweet spot but the latter type of iron type golf club heads also serves as a solid back type (muscle back type), as disclosed in JP-A-11-4922. Thus, the feeling of hitting is excellent, and a hit ball with adequate spin can be obtained.

SUMMARY OF THE INVENTION

It is an object of the invention to lower the center of gravity and increase the center-of-gravity depth in an iron type golf club head in which a recess portion in the back surface thereof is filled with a metal having low specific gravity as described above.

An iron type golf club head according to an aspect of the invention has a head body made of metal, and a filler made of low specific gravity metal lower in specific gravity than the metal of the head body. The front surface of the head body is a face surface. The lower portion of the head body is a sole portion. A recess portion is formed in the back surface of the head body so that the recess portion is located above the sole portion. The recess portion is filled with the filler. A back weight is fixedly attached to the sole portion so as to cover a lower portion of the rear surface of the filler.

In the iron type golf club head according to the invention, the recess portion is provided in the back surface of the head body, and the metal with which the recess portion is filled has smaller specific gravity than that of the head body. Thus, the iron type golf club head has a wide sweet spot. In addition, since the golf club head is a solid back type, the feeling of hitting is excellent, and a hit ball with adequate spin can be obtained. According to the invention, the back weight is provided in the rear surface of the low specific gravity metal with which the recess portion is filled. Thus, the center-of-gravity depth is deep. In addition, since the back weight is disposed in the lower portion, the center of gravity of the golf club head is lowered so that a high launch angle can be obtained.

It is preferable that the back weight is fixedly attached to the back surface of the head body also in opposite side portions of the filler.

It is preferable that the back weight is made of the same metal as the metal of the head body or metal higher in specific gravity than the metal of the head body.

It is preferable that the back weight is fixedly attached to the filler by caulking.

Incidentally, the head body and the back weight may be fixedly attached to each other in their contact portions by welding. In this case, if the welded portion is ground, the external appearance of the head will be attractive.

DETAILED DESCRIPTION OF THE PREFERRED EMBODIMENTS

Figure 1:
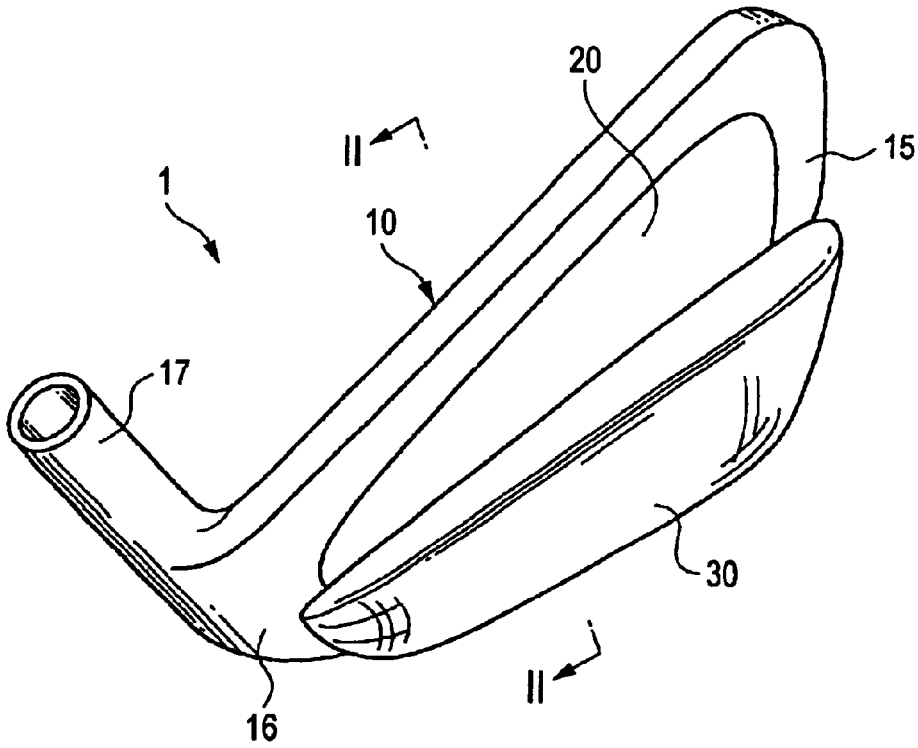
FIG. 1 is a perspective view of an iron type golf club head according to an embodiment of the invention, viewed from its back side.
Figure 2:
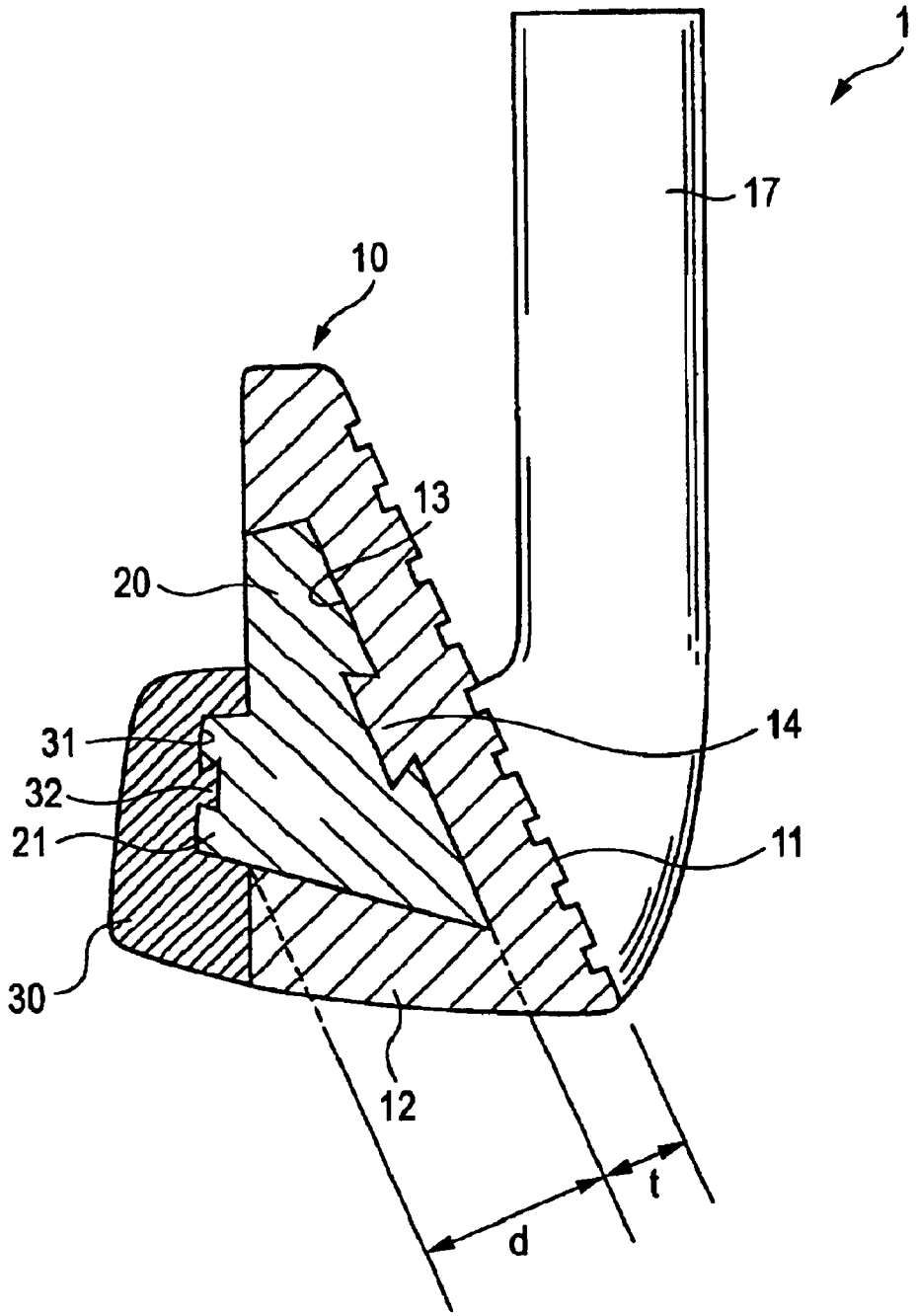
FIG. 2 is a sectional view taken on line II—II in FIG. 1.

Description will be made below on an embodiment of the invention with reference to the drawings. FIG. 1 is a perspective view of an iron type golf club head according to an embodiment of the invention, viewed from its back side. FIG. 2 is a sectional view taken on line II—II in FIG. 1.

This golf club head 1 has a head body 10, a filler 20 fixedly attached to a recess portion 13 of the head body 10, and a back weight 30 disposed on the rear surface side of the filler 20 and fixedly attached to a sole portion 12 of the head body 10.

The front surface of the head body 10 is a face surface 11, and the lower portion of the head body 10 is a sole portion 12. The recess portion 13 is provided in the back surface of the head body 10. The recess portion 13 is caved in an upper portion, a lower portion and opposite side portions of the head body 10.

A protrusion portion 14 is provided in the depth-direction bottom surface (the back side surface of the face surface 11) in the recess portion 13. The protrusion portion 14 has a dovetail shape in which the base end side (root side) is narrower than the front end side (height-direction front end side). The protrusion portion 14 extends in the width direction (the direction connecting a toe 15 and a heel 16) of the head body 10, but does not reach either end of the recess portion 13 in the width direction of the head body 10. Although only one protrusion portion 14 is provided in this embodiment, a plurality of protrusion portions 14 separated in the width direction of the head body 10 may be provided. Alternatively, a plurality of protrusion portions 14 separated in the up/down direction of the head body 10 may be provided.

A hosel portion 17 is provided in the head body 10. A shaft is inserted into the hosel portion 17 and fixed thereto by a bonding agent. Thus, a golf club is formed.

The head body 10 is made of a metal having high specific gravity, preferably a steel material. As the steel material, low carbon steel such as S25C is preferred when the head body 10 is forged. SUS304 or the like is preferred because of its excellent workability when the head body 10 is cast.

It is preferable that thickness t of the face portion of the head body 10 is 1–3 mm. When the thickness t is smaller than 1 mm, there is a possibility that the face portion may be deformed when the filler 20 is filled by press fitting. When the thickness t is larger than 3 mm, there is a possibility that the center-of-gravity depth of the golf club head 1 may be shallow or the weight of the golf club head 1 may be increased excessively.

It is preferable that depth d of the recess portion 13 on the side of the sole portion 12 is 5–30 mm, particularly about 8–20 mm.

Incidentally, in order to enhance the strength with which the filler 20 is fixedly attached to the head body 10, it is preferable that the recess portion 13 is formed into a dovetail groove in which the entrance side (the rear end side of the head body 10) is narrower than the deeper side.

The protrusion portion 14 is formed, for example, by machining. It is preferable that the height of the protrusion portion 14 is about 1.0–3.0 mm. Not to say, the height of the protrusion portion 14 is smaller than the depth of the recess portion 13.

The filler 20 mounted into the recess portion 13 is made of low specific gravity metal whose specific gravity is preferably not higher than 5.0, more preferably 1.7–4.6.

The filler 20 is pressed into the recess portion 13 so as to be engaged with the protrusion portion 14 and brought into tight contact with the whole inner surface of the recess portion 13.

In order to make it easy to plastically deform the metal material of the filler in this press fitting, it is preferable that the Vickers hardness of the metal material of the filler 20 is not higher than 250 Hv.

Incidentally, when the Vickers hardness is too low, the filler 20 becomes easy to be damaged. It is therefore preferable that the Vickers hardness is not lower than 40 Hv. After the filler 20 is mounted, treatment for enhancing the surface hardness, such as oxidation treatment, may be applied to the filler 20. For example, when the metal material is aluminum or an aluminum alloy, alumilite treatment may be applied. When the metal material is titanium or a titanium alloy, anodizing or ion plating can be considered.

Specifically, titanium, titanium alloys, aluminum, aluminum alloys such as duralumin, and magnesium alloys are preferable as the metal material of the filler 20.

As for pure titanium, grade 1–3 pure titanium is preferred because it has a Vickers hardness of about 200 Hv or lower and is soft enough to be press-fitted. As for titanium alloys, forgeable titanium alloys such as a β alloy or Ti-4.5Al-3V-2Mo-2Fe may be used. Aluminum alloys are usually enough soft to have a Vickers hardness of about 150 Hv or lower. Therefore, there is no particular limitation on selection of the material. However, from the point of formability in forging or the like, a 1000-series aluminum alloy or a 3000-series aluminum alloy enhanced in strength in comparison with the 1000-series aluminum alloy is preferred. Incidentally, since the 1000-series aluminum alloy is very soft, it is preferable that alumite treatment is applied to the surface so as to harden surface so as to harden the surface. As for duralumin, 2014 low in Mg content is preferred because of its excellent forgeability.

A protrusion portion 21 is provided in the lower portion of the rear surface of the filler 20 so as to protrude more rearward than the back surface of the head body 10. It is preferable that the protrusion portion 21 is formed by machining after the filler 20 is pressed into the recess portion 13. Incidentally, it is preferable that, by this machining, the upper portion of the rear surface of the filler 20 is made flush with the back surface of the head body 10 surrounding the filler 20.

After the filler 20 has been mounted, the back weight 30 is mounted and fixedly attached to the rear surface of the sole portion 12 by welding. A recess portion 31 for receiving the protrusion portion 21 of the filler 20 is provided in the front surface of the back weight 30. A protrusion portion 32 is provided in this recess portion 31. This protrusion portion 32 is provided to protrude forward from the back weight 30. The protrusion portion 32 has a dovetail shape in which the front end side in the protrusion direction is expanded in comparison with the base end side. It is preferable that the height of the protrusion portion 32 in the protrusion direction is about 0.8–2.0 mm.

When the back weight 30 is mounted, the recess portion 31 of the back weight 30 is fitted to the protrusion portion 21 of the filler 20. The back weight 30 is strongly pressed onto the filler 20 so as to plastically deform the protrusion portion 21. Thus, the protrusion portion 21 is brought into tight contact with the whole inner surface of the recess portion 31. At the same time, the protrusion portion 32 and the filler 20 are fixedly attached to each other by caulking.

After the back weight 30 is pressed till the back weight 30 overlaps the rear surface of the sole portion 12 of the head body 10, the back weight 30 is fixedly attached to the sole portion 12 by welding.

The back weight 30 is welded to the rear surface of the head body 10 also on the toe 15 side and the heel 16 side where the recess portion 13 does not exist. The back weight 30 covers only substantially the lower half of the filler 20.

The back weight 30 may be made of either the same material as the head body 10 or metal higher in specific gravity than the head body 10. When the back weight 30 is made of a metal having high specific gravity thus, it is possible to make the center-of-gravity depth of the golf club head 1 sufficiently deep and the center-of-gravity height thereof sufficiently low. Examples of such a metal having high specific gravitys include copper alloys such as brass, bronze and beryllium copper, and tungsten alloys. As for the tungsten alloys, a tungsten-copper alloy having a specific gravity of 10–12, or the like, is preferred because of its excellent plastic formability. In addition, a tungsten-iron-nickel-copper alloy or the like is also preferred because it can be welded to soft iron, stainless steel or the like.

The iron type golf club head configured thus, in which the filler 20 made of low specific gravity metal is mounted in the recess portion 13, has a wide sweet spot in the same manner as the cavity back type. In addition, the feeling of hitting is good and a hit ball with adequate spin can be obtained in the same manner as in the solid back type.

In addition, the center-of-gravity depth of the golf club head 1 is deep because the back weight 30 is provided. Thus, the sweet spot is wider. Further, the back weight 30 is disposed in the lower portion of the golf club head 1 so that the center-of-gravity height of the golf club head 1 is low. Thus, the launch angle of a ball is made high.

EXAMPLE 1

A golf club head shown in FIGS. 1 to 2 was manufactured. The head body 10 was produced by hot forging of low carbon steel S25C (specific gravity 7.8, and Vickers hardness 200 Hv). The protrusion portion 14 was formed by machining. The thickness t of the face portion was set at 2 mm. The depth of the recess portion 13 was set at 6 mm on the top side and 20 mm on the sole side. The height of the protrusion portion 14 was set at 2 mm. The loft angle was set at 26°.

The filler 20 was made of grade 1 pure titanium (specific gravity 4.5, and Vickers hardness 150 Hv). A recess portion fittable to the protrusion portion 14 was provided in a raw body for the filler 20 in advance. The raw body was pressed into the recess portion 13. After the press fitting, the protrusion portion 21 was formed by working with an NC milling machine.

A W—Ni—Fe—Cu alloy having a specific gravity of 10 was used for the back weight 30. The back weight 30 was provided with the recess portion 31 and the protrusion portion 32 having a height of 1.5 mm in advance. After the recess portion 31 and the protrusion portion 21 of the filler 20 were fitted to each other, press fitting was done. After that, the back surface of the sole portion 12 of the head body 10 was fixedly attached to portions of the back weight abutting against the back surface on the toe side and on the sole side, by TIG welding. Bead portions formed by the welding were made smooth by grinding. Thus, the golf club head was finished with an attractive appearance.

A carbon shaft was attached to the golf club head, and used for actual shots. Table 1 shows the evaluation result of the actual shots.

EXAMPLE 2

A golf club head was manufactured in the same manner as in Example 1, except that the back weight 30 was made of S25C material which was the same as the material of the head body 10. Table 1 shows the result of a similar evaluation test carried out on the golf club head.

COMPARATIVE EXAMPLE 1

A golf club head was manufactured in the same manner as in Example 1, except that only the back weight 30 was mounted without any filler 20 mounted into the recess portion 13. Table 1 shows the result of a similar evaluation test carried out on the golf club head.

COMPARATIVE EXAMPLE 2

A golf club head was manufactured in the same manner as in Example 1, except that the back weight 30 was not provided. Table 1 shows the result of a similar evaluation test carried out on the golf club head.

TABLE 1

| | ball flight | Feeling of hitting | rating |
|---|---|---|---|
| Example 1 | ◎ Launch angle is high enough to hit a ball high. Flight is stable. | ○ Feeling of hitting is steady and excellent. | ◎ |
| Example 2 | ○ Flight is stable. | ○ Feeling of hitting is steady and excellent. | ○ |
| Comparative Example 1 | ○ Flight is stable. | × Feeling of hitting is light, and ball release is quick. The place of the face where a ball was hit cannot be grasped. | Δ |
| Comparative Example 2 | × sweet area seems to be narrower than that in any other head. | ○ Feeling of hitting is steady and excellent. | Δ |

◎: very good ○: good Δ: normal ×: bad

From the results, it was recognized that Examples 1 and 2 were more excellent in feeling of hitting and more stable in flight than Comparative Examples 1 and 2.

As described above, according to the invention, an iron type golf club head excellent in feeling of hitting and stable in flight is provided.

What is claimed is:

1. An iron type golf club head comprising:

a head body made of metal, comprising:

a face surface in a front surface thereof;

a sole portion in a lower portion thereof; and a recess portion in a back surface thereof, the recess portion formed above the sole portion;

a filler with which the recess portion is filled and which is made of metal having a lower specific gravity than that of the metal of the head body; and a back weight fixedly attached to the sole portion so as to cover only substantially a lower portion of a rear surface of the filler, wherein:

the filler includes a protrusion that protrudes from the rear surface of the filler; and the back weight engages with the protrusion of the filler.

2. The iron type golf club head according to claim 1, wherein the back weight is fixedly attached to a back surface of the head body in opposite side portions of the filler.

3. The iron type golf club head according to claim 1, wherein the back weight is made of the same metal as the metal of the head body.

4. The iron type golf club head according to claim 1, wherein the back weight is made of metal higher in specific gravity than the metal of the head body.

5. The iron type golf club head according to claim 1, wherein:

the filler includes the protrusion at the lower portion of the rear surface thereof.

6. An iron type golf club head comprising:

a head body made of metal and having:

a face surface in a front surface thereof;

a sole portion in a lower portion thereof; and a recess portion in a back surface thereof, the recess portion formed above the sole portion;

a filler with which the recess portion is filled and which is made of metal having low specific gravity lower in specific gravity than the metal of the head body; and a back weight fixedly attached to the sole portion so as to cover only substantially a lower portion of a rear surface of the filler, wherein the back weight is fixedly attached to the filler by caulking.

7. The iron type golf club head according to claim 6, wherein the filler includes at least one of aluminum and aluminum alloy.

8. The iron type golf club head according to claim 6, wherein the filler includes at least one of titanium and titanium alloy.

9. The iron type golf club head according to claim 6, wherein the back weight includes at least one of tungsten alloy and beryllium copper.

10. An iron type golf club head comprising:

a head body made of metal, comprising:

a face surface in a front surface thereof;

a sole portion in a lower portion thereof; and a recess portion in a back surface thereof, the recess portion formed above the sole portion;

a filler with which the recess portion is filled and which is made of metal having a lower specific gravity than the metal of the head body; and a back weight fixedly attached to the sole portion so as to cover only substantially a portion of a lower rear surface of the filler, wherein the back weight is fixedly attached to the filler.

11. The iron type golf club head according to claim 10, wherein the filler includes at least one of aluminum and aluminum alloy.

12. The iron type golf club head according to claim 10, wherein the filler includes at least one of titanium and titanium alloy.

13. The iron type golf club head according to claim 10, wherein the back weight includes at least one of tungsten alloy and beryllium copper.

* * * * *